US005165268A

United States Patent [19]

Visser

[11] Patent Number: 5,165,268

[45] Date of Patent: Nov. 24, 1992

[54] EXTRUSION PULLER MOUNTING

[75] Inventor: James T. Visser, Ada, Mich.

[73] Assignee: Granco Clark, Inc., Belding, Mich.

[21] Appl. No.: 661,482

[22] Filed: Jan. 2, 1991

Related U.S. Application Data

[63] Continuation of Ser. No. 438,575, Nov. 16, 1989, abandoned.

[51] Int. Cl.[5] ..... B21C 35/02

[52] U.S. Cl. ..... 72/257; 104/246

[58] Field of Search ..... 72/257; 104/107, 246

[56] References Cited

U.S. PATENT DOCUMENTS

| | | | |
|---|---|---|---|
| 3,580,183 | 5/1971 | Nearman | 104/111 |
| 3,585,833 | 6/1971 | Carraher | 72/257 |
| 3,739,619 | 6/1973 | Follrath | 72/257 |
| 3,881,339 | 5/1975 | Mannell | 72/257 |
| 4,079,616 | 3/1978 | Zazimko | 72/278 |
| 4,313,329 | 2/1982 | Caswall, Jr. | 72/257 |
| 4,375,195 | 3/1983 | Tsuboi | 104/246 |
| 4,507,950 | 4/1985 | Elhaus | 72/257 |
| 4,628,719 | 12/1986 | Best | 72/257 |
| 4,790,167 | 12/1988 | Gentry | 72/257 |

FOREIGN PATENT DOCUMENTS

| | | | |
|---|---|---|---|
| 1371424 | 10/1974 | United Kingdom | 104/246 |

OTHER PUBLICATIONS

European Patent No. EP0300262, Jan. 25, 1989 Inventor: Horst Groos et al.

*Primary Examiner*—John Sipos
*Assistant Examiner*—Donald M. Gurley
*Attorney, Agent, or Firm*—Varnum, Riddering, Schmidt & Hewlett

[57] ABSTRACT

An extrusion pulling apparatus wherein an extrusion puller is guided from above and below for movement along an extrusion line from an extrusion press. The upper guide comprises a T-shaped beam with rollers mounted on the puller for rolling along vertical surfaces of the beam. The lower guide is formed from a multi-face beam, for example, a hexagonal beam, wherein rollers mounted on the puller roll on guide face surfaces which have an included angle between them of about 60°. The upper and lower guides can be reversed.

10 Claims, 5 Drawing Sheets

EXTRUSION PULLER MOUNTING

This is a continuation, of application Ser. No. 07/438,575 filed Nov. 16, 1989, now abandoned.

TECHNICAL FIELD

The invention relates to extrusion pulling apparatus and, more particularly, to an extrusion pulling apparatus mounted on a multifaceted guide beam through rollers.

BACKGROUND OF THE INVENTION

It is well known for extrusion pulling apparatus to incorporate guide means for tracking the extrusion pulling jaws along the extrusion pulling axis. Further, the guide means typically incorporate a plurality of rollers for movement of the extrusion pulling apparatus along the guide means. Typically, the rollers and guide means are mounted either below, or above the extrusion pulling apparatus and provide the sole means for stability and support for the extrusion pulling apparatus.

The Mannell U.S. Pat. No. 3,881,339 (issued May 6, 1975) discloses an extrusion puller comprising an elongated rectangular rail with a carriage moveable along said rail on several sets of rollers. The rollers roll on the rectangular rail on the top, bottom and side surfaces for guiding the extrusion puller along the extrusion axis.

The Zazimko, et al. U.S. Pat. No. 4,079,616 (issued Mar. 21, 1978) discloses a draw bench for producing cylindrical tubular items. A roller mounted carriage is mounted on a set of rollers to traverse the drawing axis.

An extrusion pulling apparatus with the guide means mounted above the extrusion puller is disclosed in Best U.S. Pat. No. 4,628,719 (issued Dec. 16, 1986). The guide means are essentially an inverted W-shape cross-section wherein the rollers of the extrusion puller are inserted into the bight portions of the inverted W-shaped guide means and supported on an inward extending flange. Rollers are incorporated on the extrusion puller for tracking along the flanges.

Another example of an upper mounted guide means is found in Carraher et al. U.S. Pat. No. 3,585,833 (issued Jun. 22, 1971). A pair of I-shaped beams are mounted such that rollers of the extrusion puller are supported by the flanges of the I-shaped beam.

Other patents which disclose the use of a roller and guide means construction similar to those previously discussed include Caswall, J. R. et al. U.S. Pat. No. 4,313,329 (issued Feb. 2, 1982); Elhaus U.S. Pat. No. 4,507,950 (issued Apr. 2, 1985); and Nearman U.S. Pat. No. 3,580,183 (issued May 25, 1971).

It is also known in the prior art to utilize an I-beam as the guide means for the extrusion pulling apparatus. Rollers are mounted for rolling contact on a horizontal face of the I-beam and provide support for the extrusion pulling apparatus. In addition, rollers are mounted on the underside of the flanges of the I-beam to provide stability and tracking for the extrusion puller.

It is important to construct an extrusion puller which is extremely stable to avoid irregularities in the extruded/pulled material. A common source for such irregularities is a slip or studder in the extrusion puller apparatus. Therefore, an apparatus which decreases the frequency of slips or studders in the extrusion puller will increase the productivity of the extrusion pulling apparatus.

SUMMARY OF THE INVENTION

According to the invention, an extrusion puller apparatus has a lower guide means mounted beneath the puller and an upper guide mounted above the puller for movement of the puller along a line from an extrusion press. One of the guides comprises a multi-face beam with at least three guide face surfaces oriented approximately 60° apart and at least three rollers which roll on the three guide face surfaces. The multi-face beam supports the puller through at least one of the three rollers, the other rollers providing stability for the puller.

The other of the upper and lower guides has lateral stabilizing guide surfaces and at least two second rollers, one of which rolls on each side of the lateral stabilizing guide surfaces.

Preferably, one of the upper and lower guides comprises a hexagonal beam and the lateral stabilizing guide surfaces of the other guide are vertical.

An extrusion puller mounting which supplies a great amount of support and stability is created when the hexagonal beam comprises the lower guide means and a T-shaped beam comprises the upper guide means. The T-shaped beam incorporates vertical surfaces as the lateral stabilizing guide surfaces. Further, the rollers which roll on the three guide face surfaces of the hexagonal beam are mounted on axes which are spaced approximately 60° from each other. The rollers for the upper guide, or T-shaped beam, have axes parallel to each other.

The invention provides more stability and support for the extrusion puller apparatus than is found in the prior art. Therefore, fewer defects will be found in the extruded material and a greater productivity will be achieved with the apparatus.

BRIEF DESCRIPTION OF DRAWINGS

The invention will now be described in detail with reference to the accompanying drawings wherein.

DESCRIPTION OF THE PREFERRED EMBODIMENT

Figure 1:
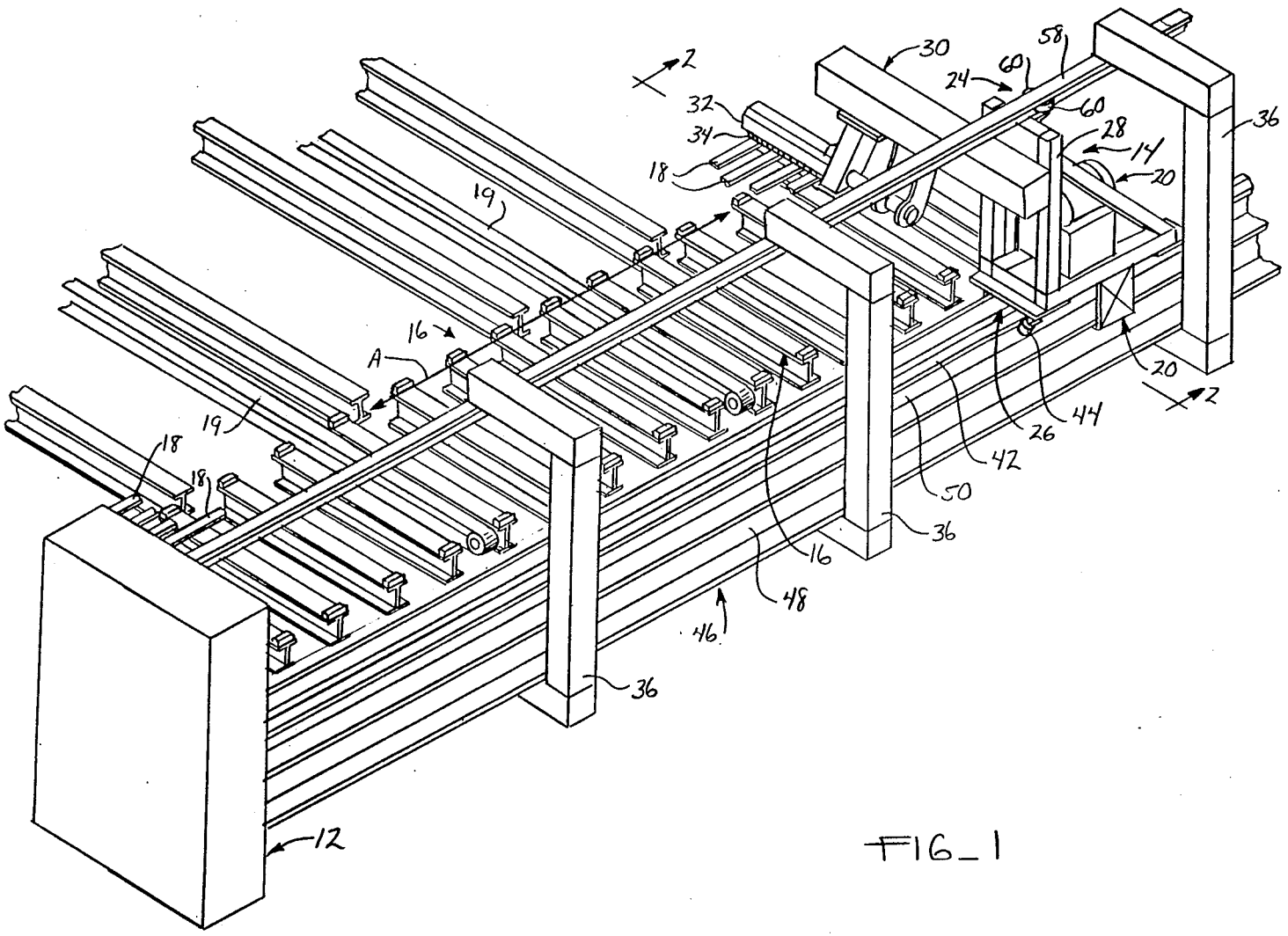
FIG. 1 is a perspective view of an extrusion pulling apparatus.

Referring to FIG. 1, an extrusion puller 14 is mounted on a lower guide 26 and an upper guide 28 for movement along a run out table 16 from an extrusion press 12. It is well known in the art to construct a pulling apparatus wherein the material to be pulled 18 is forced through the extrusion press 12 and gripped by the extrusion puller 14. The extrusion puller 14 is driven away from the extrusion press 12 along the extrusion axis A by a suitable drive means which may include a chain (not shown) beneath the run-out table 16 (not shown) and a chain connector 20. After the extrusion is completed, the extruded material 18 is moved to a cooling table 17 for further processing by a belt conveyor 19.

Figure 2:
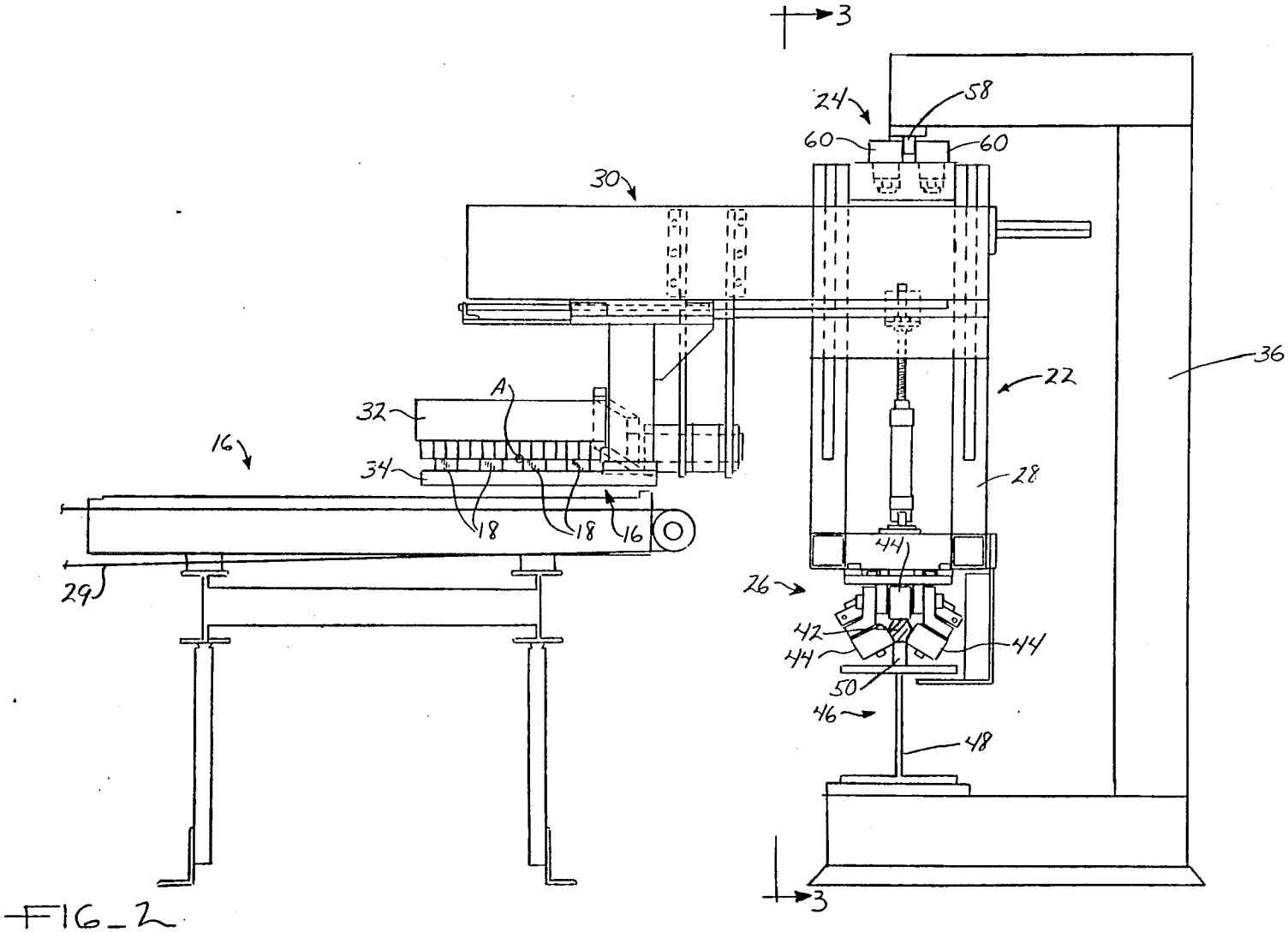
FIG. 2 is a partial sectional view along lines 2—2 of FIG. 1.

As seen in FIG. 2, the extrusion puller 14 is guided along the pulling axis A by an extrusion puller mounting 22. The extrusion puller mounting 22 of the invention is guided by an upper guide 24 and a lower guide 26. These guides help to provide support and linear accuracy in the extrusion process.

The extrusion puller mounting 22 comprises a rectangular support frame 28 which is mounted between the upper guide 24 and the lower guide 26. Fixedly attached to the rectangular frame 28 is a suitable mounting structure 30 for a pair of extrusion puller jaws, an upper jaw 32 and a lower jaw 34. The puller jaw mounting structure 30 is arranged such that the puller jaws 32, 34 are above and adjacent to the run out table 16. On the opposite side of the rectangular frame 28 from the mounting structure 30 and puller jaws 32, 34 is a C-shaped support frame 36. The C-shaped support frame 36 provides support for the rectangular support frame 28 along the extrusion axis A through the upper and lower guide 24, 26.

The lower guide 26 comprises a hexagonal beam 42, and a plurality of rollers 44. The rollers 44 are typically constructed of steel. The hexagonal beam 42 may be constructed of steel and is typically rolled to close tolerances to provide accurate and studder-free extrusion pulling.

The hexagonal beam 42 extends parallel to the extrusion axis A and is supported by a suitable support means 46. In the preferred embodiment the support means 46 comprises a conventional I-beam 48 and a narrow width rectangular beam 50. The I-beam 48 is attached to the C-shaped support frame 36 by a suitable means such as welding; the narrow width rectangular beam 50 is fixedly attached to the top surface of the I-beam 48 by welding and the hexagonal beam 42 is fixedly attached to the top surface of the narrow width rectangular beam 50 by bolts.

The upper guide 24 comprises a T-shaped beam 58 and a pair of rollers 60. The T-shaped beam 58 is fixedly attached to the C-shaped support frame 36 through a suitable means such as welding. The T-shaped beam 58 extends parallel to the extrusion axis A. The rollers 60 are rotatably mounted to the rectangular support frame 28 such that one roller lies on each side of the vertical leg of the T-shaped beam 58. The rollers 60 are typically constructed of steel and the T-shaped beam 58 can be constructed of a suitable structural material such as steel.

Figure 3:
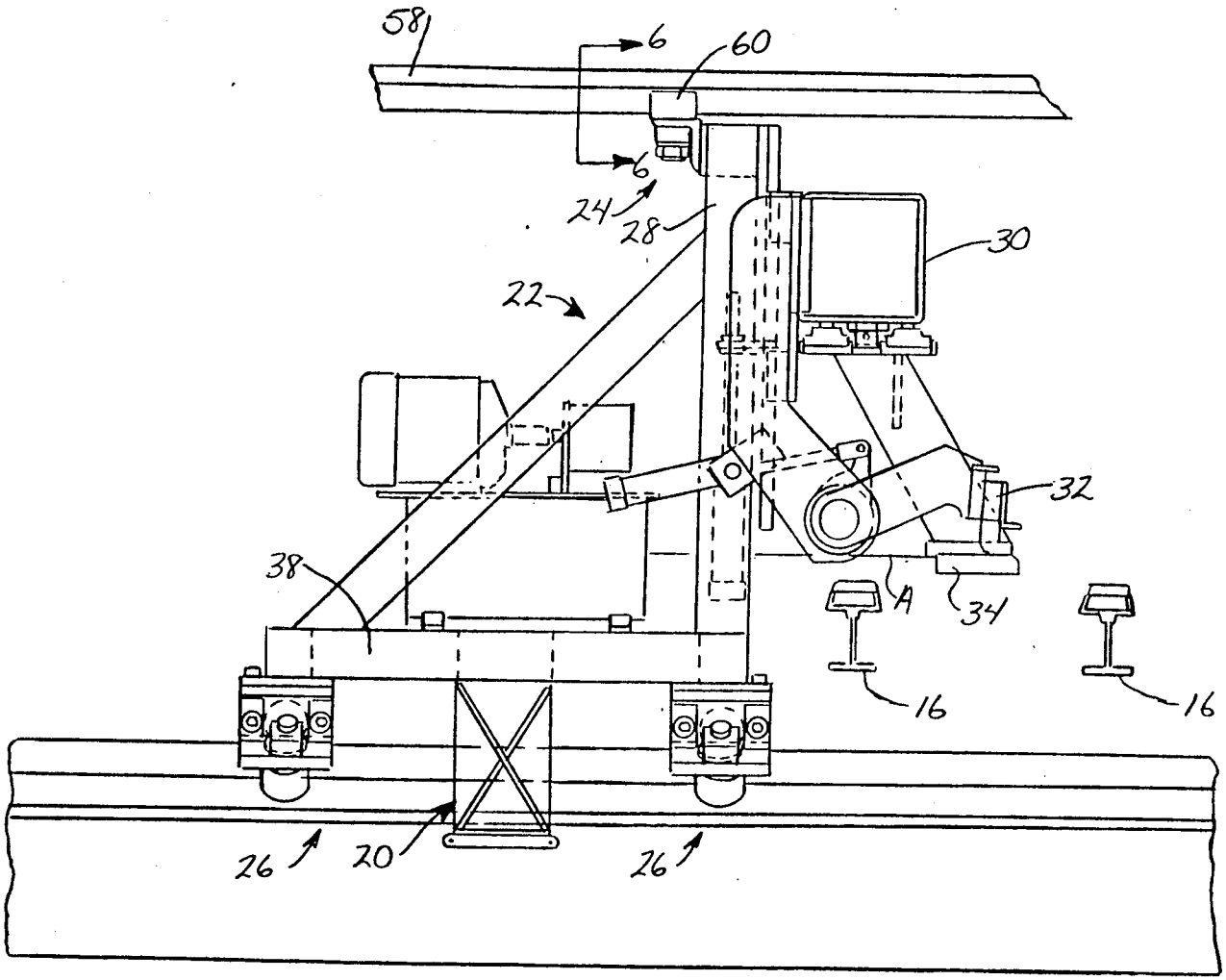
FIG. 3 is a partial side view of the extrusion puller mounting along lines 3—3 of the FIG. 2.

As seen in FIG. 3, the extrusion puller mounting 22 incorporates two lower guides 26 and a single upper guide 24. The two lower guides 26 are spaced a distance apart along a leg 38 to provide additional stability and accuracy during the pulling operation.

Figure 4:
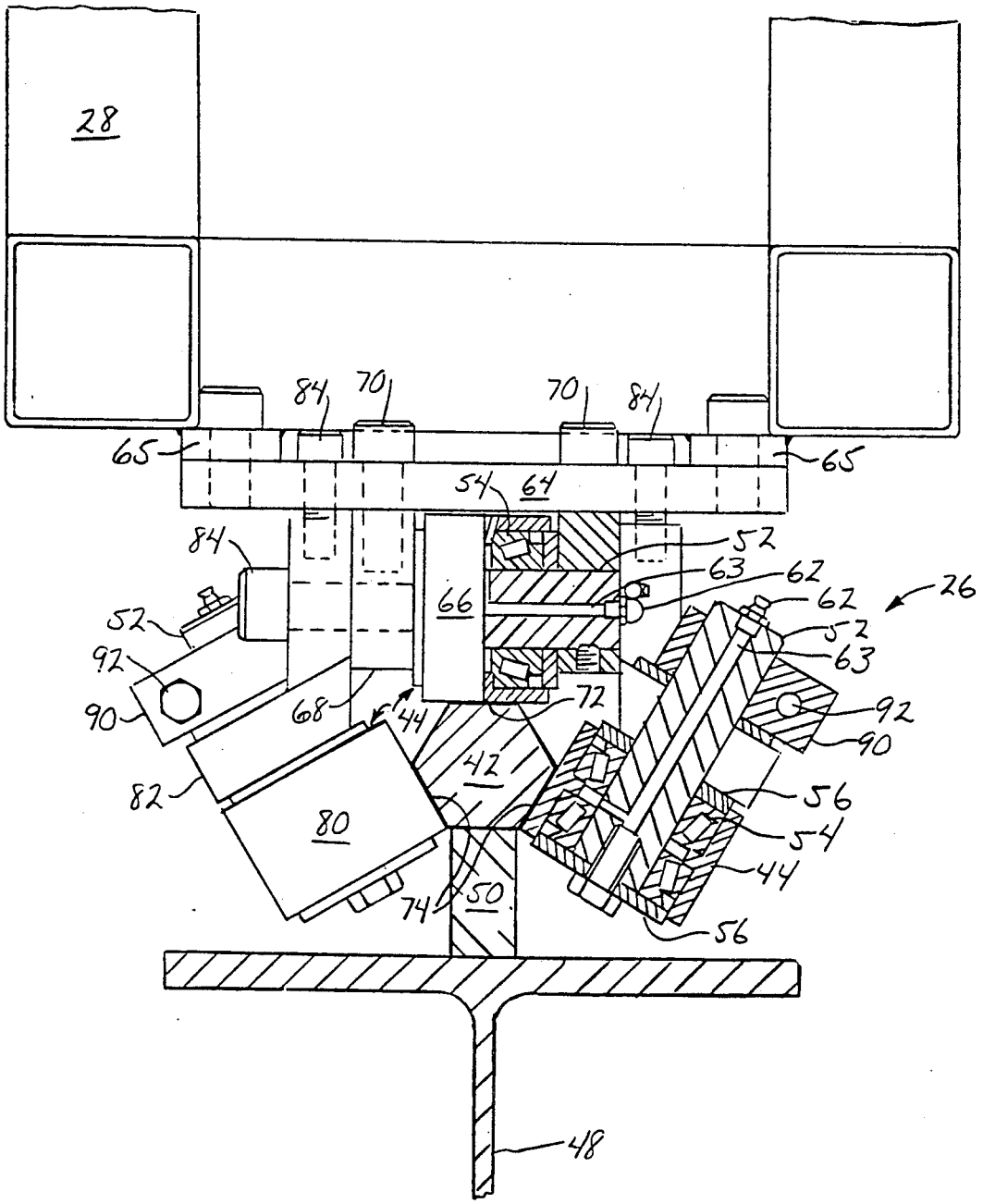
FIG. 4 is a partial enlarged view of the lower guide seen in FIG. 2.
Figure 5:
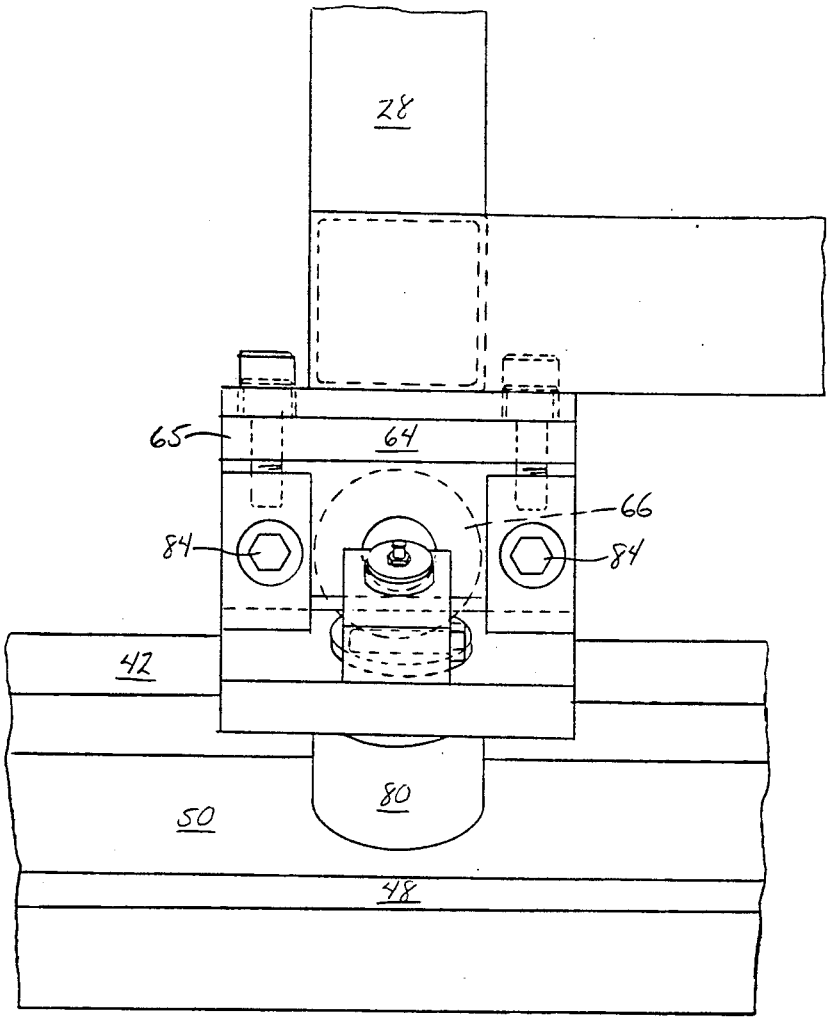
FIG. 5 is a partial enlarged side view of the lower guide seen in FIG. 3.

As seen in FIGS. 4 and 5, the preferred embodiment of the lower guide 26 incorporates a set of three rollers 44 mounted for rolling contact on three sides of the hexagonal beam 42. In FIG. 4, portions of the rollers and mounting structure are broken away to show details of the construction. The top roller 66 provides support for the extrusion puller mounting 22 and the side rollers 80 provide stability during the extrusion operation. The top roller 66 rolls along a support surface 72 and the side rollers 80 roll along stability surfaces 74 of the hexagonal shaped beam 42. The support surfaces 72 and 74 are oriented at 60 with respect to each other. That is, the intersection of surfaces 72 and 74 when extended have an included angle of 60.

Each of the rollers 44 is mounted on a cylindrical axle 52. The axes 52 are oriented 60° with respect to each other. Contained within the body of the roller 44 are suitable bearings 54 which allow for efficient rotation of the rollers 44 about the axles 52. Suitable roller washers 56 are mounted on each end of the bearings which are lubricated through a conventional grease fitting 62 in the axle 52. The grease fitting 62 communicates directly with a hollow canal within the axle 63 which in turn communicates with the bearings 54 and allows grease to flow from the grease fitting 62 to the bearings 54.

A mounting plate 65 is fixedly attached to the rectangular support frame 28 through a suitable means such as welding. In the preferred embodiment, the mounting plate 65 is welded directly to the bottom surface of the rectangular support frame 28. Fixedly attached to the mounting plate 65 is a base plate 64. The base plate 64 and the mounting plate 65 provide the support and mounting structure for the lower guide 26.

The top roller 66 of the lower guide 26 is fixedly attached to the base plate 64 through a fixed roller mounting 68 and mounting screws 70. The mounting screws 70 extend through an appropriate opening in the base plate 64 and are threaded directly into the fixed roller mount 68. The axle 52 for the top roller 66 is securely mounted in the fixed roller mount 68. The top roller 66 freely rotates on the axle 52 through bearings 54 while the fixed roller mount 66 supports the weight of the extrusion puller mounting 22.

The side rollers 80 are mounted in an adjustable roller mount 82 which is generally J-shaped. The adjustable roller mount 82 is attached to the fixed roller mount 68 through the use of mounting screws 84. The mounting screws 84 are inserted through an appropriate opening in the vertical portion of the J-shaped adjustable roller mount 82 and are threaded directly into the fixed roller mount 68. The axle 52 for the side rollers 80 extends through an appropriate opening in the lower portion of the J-shaped adjustable roller mount 82 and is fixedly attached to the adjustable roller mount 82 through an adjustable C-clamp 90 and tightening screw 92. The C-clamp 90 surrounds the axle 52 and through the tightening of the tightening screw 92 may securely clamp the axle 52 of the side roller 80 in place. Adjustments of the side rollers 80 for proper alignment of the side rollers 80 on the stability surfaces 74 can be made by adjusting the mounting screws 84 which raise or lower J-shaped mount 82.

Figure 6:
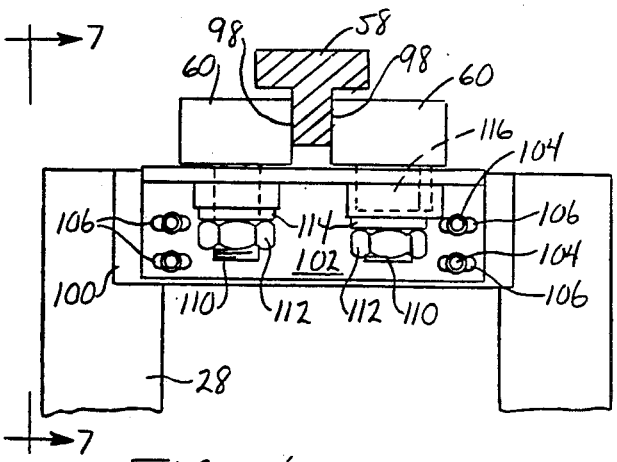
FIG. 6 is a partial sectional view along lines 6—6 of FIG. 3.
Figure 7:
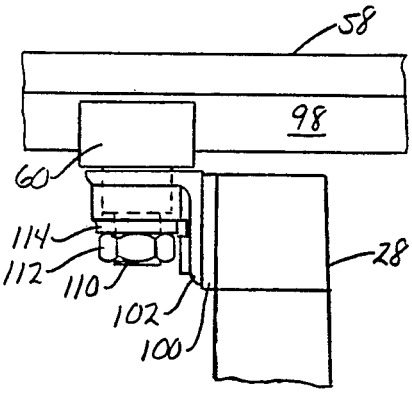
FIG. 7 is a partial enlarged view of the upper guide as seen along lines 7—7 of FIG. 6.

As seen in FIGS. 6 and 7, the preferred embodiment of the upper guide 24 incorporates a set of two rollers 60 on each side of the T-shaped beam 58. The rollers 60 roll along a lateral stabilizing guide surface 98 of the T-shaped beam 58. In the preferred embodiment, the lateral stabilizing guide surfaces 98 are vertical. The T-shaped beam 58 is shown in one piece but can be made of two bar stock pieces bolted together perpendicular to each other.

The upper guide 24 is fixedly attached to the rectangular support frame 28 through a mounting plate 1 and a L-shaped roller mount 102. The mounting plate 100 is fixedly attached to the rectangular support frame 28 through a suitable means such as welding. The L-shaped roller mount 102 is fixedly attached to the mounting plate 100 through a plurality of mounting screws 104. The mounting screws 104 are inserted through a plurality of appropriate openings 106 in the L-shaped roller mounting 102. The openings 106 are oval in shape to allow for horizontal adjustment of the L-shaped roller mounting 102.

The rollers 60 are mounted on axles 110. Suitable bearings (not shown) are constructed on the inside of the rollers 60 to allow for efficient rolling action of the rollers 60 on the axle 110. The bearings are similar to those described previously for the lower guide 26.

The axles 110 extend through an appropriate opening in the horizontal face of the L-shaped roller mounting 102 and are held in place by a conventional nut 112 and lock washer 114. The bottom portion of the axle 110 is threaded to provide for cooperation with the nut 112.

The upper guide 24 help provide for efficient and studder-free tracking of the extrusion puller mounting 22 along the extrusion axis A. In order to maintain the most accurate movement of the extrusion puller mounting 22 along the extrusion axis A, the upper guide 24 is provided with a suitable mechanism for making minor adjustments in the alignment of the rollers 60. To this end, one of the two roller axles is provided with an eccentric mounting 116. The eccentric shape allows for the transverse movement of one of the rollers 60 relative to the other so that the two rollers can be adjusted snug against the T-shaped beam 58.

The preferred embodiment discloses the incorporation of the hexagonal beam as the lower guide and the T-shaped beam as the upper guide, although it is clear that these two guides can be reversed. The hexagonal beam can be incorporated as the upper guide and provide both support and stability for the extrusion puller when the puller is suspended from the beam. Further, the T-shaped beam could likewise be incorporated as the lower guide and still provide lateral stability for the suspended extrusion puller.

The preferred embodiment provides for the use of three surfaces on the hexagonal beam, wherein the guide surfaces of the hexagonal beam are oriented approximately 60° apart. However, it is to be understood that the exact angle and configuration can vary provided the extrusion puller is still supported and stabilized by three guide surfaces which have acute angles between them. In addition, there is no need that the beam be hexagonal in shape, any multi-face beam could be used provided the support and stability functions are still accomplished through three surfaces oriented 60° apart.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modification as incorporate those features which constitute the essential features of these improvements within the true spirit and scope of the invention.

I claim:

1. In an extrusion pulling apparatus comprising an extrusion puller which is guided by a lower guide beneath said puller and guided by an upper guide above the puller for movement along a line from an extrusion press, wherein slippage of said puller with respect to the upper or lower guides results in undesirable irregularities in the work, the improvement comprising;

one of the upper and lower guides comprises a multi-faced beam with at least three guide face surfaces oriented approximately 60° apart;

said one upper or lower guides has at least three first rollers which are aligned to roll on three guide face surfaces of the multi-faced beams for accurate extrusion pulling wherein at least one of said three first rollers is adjustable to accurately align the roller to the guide surface of said multi-faced beam;

said multi-faced beam supports the puller through at least one of the three rollers;

the other of the upper and lower guides has a lateral stabilizing guide surface; and said puller has at least two second rollers, one of which rolls on each side of the lateral stabilizing guide surfaces.

2. An extrusion pulling apparatus according to claim 1 wherein one of the said upper and lower guides comprises a hexagonal beam.

3. An extrusion pulling apparatus according to claim 2 wherein said hexagonal beam is the lower guide.

4. An extrusion pulling apparatus according to claim 3 wherein said upper guide comprises a T-shaped beam.

5. An extrusion pulling apparatus according to claim 2 wherein said lateral stabilizing guide surfaces are vertical.

6. An extrusion pulling apparatus according to claim 2 wherein said other guide means comprises a T-shaped beam.

7. An extrusion pulling apparatus according to claim 2 wherein said rollers which roll on the three guide face surfaces are mounted on axes which are oriented approximately 60° from each other.

8. An extrusion pulling apparatus according to claim 1 wherein said rollers which roll on the lateral stabilizing guide surfaces have axes parallel to each other.

9. An extrusion pulling apparatus according to claim 1 wherein said upper guide comprises a T-shaped beam.

10. An extrusion pulling apparatus according to claim 1 wherein said rollers which roll on the three guide face surfaces are mounted on axes which are oriented approximately 60° from each other.

* * * * *

UNITED STATES PATENT AND TRADEMARK OFFICE

CERTIFICATE OF CORRECTION

PATENT NO. : 5,165,268

DATED : November 24, 1992

INVENTOR(S) : JAMES T. VISSER

It is certified that error appears in the above-identified patent and that said Letters Patent is hereby corrected as shown below:

Claim 6, Col. 6, line 38, please delete the word "means".

Signed and Sealed this

Twenty-sixth Day of October, 1993

*Attest:*

*Attesting Officer*

Bruce Lehman

BRUCE LEHMAN

*Commissioner of Patents and Trademarks*